US010696518B2

(12) United States Patent
Sudi et al.

(10) Patent No.: US 10,696,518 B2
(45) Date of Patent: Jun. 30, 2020

(54) METHOD OF AUTOMATED TESTING FOR AN ELEVATOR SAFETY BRAKE SYSTEM AND ELEVATOR BRAKE TESTING SYSTEM

(71) Applicant: Otis Elevator Company, Farmington, CT (US)

(72) Inventors: Sandeep Sudi, Unionville, CT (US); Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 221 days.

(21) Appl. No.: 15/477,295

(22) Filed: Apr. 3, 2017

(65) Prior Publication Data

US 2018/0282122 A1 Oct. 4, 2018

(51) Int. Cl.
*B66B 5/00* (2006.01)

(52) U.S. Cl.
CPC ..... *B66B 5/0093* (2013.01); *B66B 5/0031* (2013.01); *B66B 5/0037* (2013.01)

(58) Field of Classification Search
CPC .... B66B 5/0093; B66B 5/0031; B66B 5/0037
USPC ..... 187/393
See application file for complete search history.

(56) References Cited

U.S. PATENT DOCUMENTS 3,838,891 A * 10/1974 Hamelin ..... B60T 8/885 188/DIG. 1
4,002,973 A * 1/1977 Wiesendanger ..... B66B 5/0087 187/391
4,771,865 A 9/1988 Hinderling
5,233,139 A * 8/1993 Hofmann ..... B66B 5/0087 187/251
5,531,294 A * 7/1996 Burton ..... B66B 1/28 187/292
5,578,801 A * 11/1996 Hofmann ..... B66B 1/28 187/287
6,056,088 A * 5/2000 Gerstenkorn ..... B66B 5/0031 187/390
6,173,814 B1 1/2001 Herkel et al.
6,269,911 B1 8/2001 Richter
6,325,179 B1 * 12/2001 Barreiro ..... B66B 5/0037 187/393
6,330,935 B1 12/2001 Systermans
6,863,161 B2 3/2005 Mearns et al.
(Continued)

FOREIGN PATENT DOCUMENTS

CN 101016130 A 8/2007
CN 101016132 A 8/2007
(Continued)

OTHER PUBLICATIONS

Search Report regarding related EP App. No. 1165544.0; dated Sep. 3, 2018; 8 pgs.

*Primary Examiner* — David S Warren
(74) *Attorney, Agent, or Firm* — Cantor Colburn LLP

(57) ABSTRACT

A method of testing of an elevator safety brake system is provided. The method includes initiating an automated test procedure. The method also includes triggering an electronic safety actuator. The method further includes generating braking data about performance of the electronic safety actuator. The method yet further includes analyzing the braking data. The method also includes generating a report to indicate whether the elevator safety brake system performed adequately.

19 Claims, 7 Drawing Sheets

(56) References Cited

U.S. PATENT DOCUMENTS

| | | | | |
|---|---|---|---|---|
| 7,002,462 | B2 | 2/2006 | Welch | |
| 7,073,633 | B2 | 7/2006 | Weinberger et al. | |
| 7,172,055 | B2 | 2/2007 | Engel et al. | |
| 7,222,698 | B2 * | 5/2007 | Hanninen | B66B 5/0093 187/393 |
| 7,268,514 | B2 * | 9/2007 | DeLange | B66B 1/30 187/291 |
| 7,350,883 | B2 * | 4/2008 | Hubbard | B66B 5/0018 187/393 |
| 7,527,127 | B2 * | 5/2009 | Osterman | B66B 5/0031 187/288 |
| 7,575,099 | B2 | 8/2009 | Oh et al. | |
| 7,617,911 | B2 * | 11/2009 | Mattila | B66B 5/0031 187/288 |
| 7,721,852 | B2 | 5/2010 | Ishioka et al. | |
| 7,775,330 | B2 * | 8/2010 | Kattainen | B66B 5/04 187/287 |
| 8,028,807 | B2 | 10/2011 | Deplazes et al. | |
| 8,443,944 | B2 | 5/2013 | Sonnenmoser et al. | |
| 8,540,057 | B2 | 9/2013 | Schuster et al. | |
| 8,602,170 | B2 * | 12/2013 | Fischer | B66B 11/043 187/288 |
| 8,678,143 | B2 | 3/2014 | Bunter | |
| 8,746,413 | B2 * | 6/2014 | Schroeder-Brumloop | B66B 5/0093 187/288 |
| 8,893,858 | B2 | 11/2014 | Shi et al. | |
| 9,061,864 | B2 * | 6/2015 | Spirgi | B66B 5/0037 |
| 9,463,956 | B2 * | 10/2016 | Lahteenmaki | B66B 5/0037 |
| 9,573,792 | B2 * | 2/2017 | Aulanko | B66B 11/004 |
| 9,771,242 | B2 * | 9/2017 | Kattainen | B66B 5/0087 |
| 9,919,896 | B2 * | 3/2018 | Xie | B66B 5/0037 |
| 10,023,429 | B2 * | 7/2018 | Osmanbasic | B66B 5/0093 |
| 10,112,801 | B2 * | 10/2018 | Madarasz | B66B 5/0037 |
| 10,131,520 | B2 * | 11/2018 | Kattainen | B66D 5/30 |
| 2008/0067011 | A1 | 3/2008 | Gremaud et al. | |
| 2010/0154527 | A1 * | 6/2010 | Illan | B66B 5/0093 73/121 |
| 2014/0347649 | A1 | 11/2014 | Gehrke | |
| 2015/0251875 | A1 | 9/2015 | Lustenberger | |
| 2015/0377968 | A1 | 12/2015 | Lustenberger | |
| 2016/0368736 | A1 | 12/2016 | Kattainen et al. | |
| 2018/0134517 | A1 * | 5/2018 | Zhou | B66B 5/0037 |

FOREIGN PATENT DOCUMENTS

| | | | |
|---|---|---|---|
| CN | 101291866 | A | 10/2008 |
| CN | 101607656 | A | 12/2009 |
| CN | 102070053 | A | 5/2011 |
| CN | 102070054 | A | 5/2011 |
| CN | 104071662 | A | 10/2014 |
| CN | 204727371 | U | 10/2015 |
| CN | 105398901 | A | 3/2016 |
| CN | 105752784 | A | 7/2016 |
| CN | 205500486 | U | 8/2016 |
| EP | 2221268 | A1 | 8/2010 |
| EP | 2102087 | B1 | 3/2012 |
| GB | 2226428 | A | 6/1990 |
| JP | 0993660 | A | 4/1997 |
| JP | 2011116485 | A | 6/2011 |
| WO | 2016019783 | A1 | 2/2016 |

* cited by examiner

METHOD OF AUTOMATED TESTING FOR AN ELEVATOR SAFETY BRAKE SYSTEM AND ELEVATOR BRAKE TESTING SYSTEM

BACKGROUND

The embodiments herein relate to elevator braking systems and, more particularly, to a system and method for automated testing of such braking systems.

Elevator braking systems may include a safety braking system configured to assist in braking a hoisted structure (e.g., elevator car) relative to a guide member, such as a guide rail, in the event the hoisted structure exceeds a predetermined speed or acceleration. Some braking systems include an electronic safety actuation device to actuate one or more safeties. Safeties and the electronic actuators require periodic testing that is typically performed on site manually by a technician.

BRIEF SUMMARY

According to one aspect of the disclosure, a method of testing of an elevator safety brake system is provided. The method includes initiating an automated test procedure. The method also includes triggering an electronic safety actuator. The method further includes generating braking data about performance of the electronic safety actuator. The method yet further includes analyzing the braking data. The method also includes generating a report to indicate whether the elevator safety brake system performed adequately.

In addition to one or more of the features described above, or as an alternative, further embodiments may include transferring the generated data to an elevator system processing device, wherein the elevator system processing device is at least one of an elevator system controller, a cloud server, and a service tool.

In addition to one or more of the features described above, or as an alternative, further embodiments may include that the braking data comprises at least one of a braking distance and a deceleration of an elevator car that the electronic safety actuator is coupled to.

In addition to one or more of the features described above, or as an alternative, further embodiments may include that the automated test procedure is initiated by an individual located proximate the elevator system processing device, the processing device comprising at least one of an elevator system controller, a cloud server, and any other computing device.

In addition to one or more of the features described above, or as an alternative, further embodiments may include that the individual interacts with the elevator system controller manually with a user interface.

In addition to one or more of the features described above, or as an alternative, further embodiments may include that the individual interacts with the controller with a mobile device in wireless communication with the controller.

In addition to one or more of the features described above, or as an alternative, further embodiments may include ensuring that there are no occupants in an elevator car to be tested prior to triggering the electronic safety actuator.

In addition to one or more of the features described above, or as an alternative, further embodiments may include that ensuring that there are no occupants is performed by at least one of visually ensuring with a camera viewing an interior of the elevator car and analyzing data from weight sensors.

In addition to one or more of the features described above, or as an alternative, further embodiments may include that ensuring that there are no occupants is performed automatically by an elevator system processing device with no human interaction.

In addition to one or more of the features described above, or as an alternative, further embodiments may include that the automated test procedure is initiated periodically according to a schedule programmed in the elevator system processing device, the processing device comprising at least one of an elevator system controller, a cloud server, and any other computing device.

In addition to one or more of the features described above, or as an alternative, further embodiments may include that the automated test procedure is initiated at least one of daily, weekly and monthly.

In addition to one or more of the features described above, or as an alternative, further embodiments may include establishing a remote connection between a remote device and an elevator system controller, the remote device not located at the location that the elevator system controller is located, wherein the automated test procedure is initiated by a remote operator that is remotely located relative to the elevator safety brake system and initiates the automated test procedure with a remote device.

In addition to one or more of the features described above, or as an alternative, further embodiments may include that the remote operator interacts with the remote device and security personnel at the location of the elevator system controller.

In addition to one or more of the features described above, or as an alternative, further embodiments may include ensuring that there are no occupants in the elevator car by, passing an audio and video verification, passing a load weighing verification, and passing an idle time verification.

According to another aspect of the disclosure, a method of automated testing of an elevator safety brake system is provided. The method includes initiating an automated test procedure with a processing device in operative communication with an electronic safety actuator. The method also includes triggering an electronic safety actuator. The method further includes generating braking data about performance of the electronic safety actuator. The method yet further includes analyzing the braking data. The method also includes generating a report to indicate whether the elevator safety brake system performed adequately.

In addition to one or more of the features described above, or as an alternative, further embodiments may include that the automated test is initiated by the processing device based on a periodic test schedule.

In addition to one or more of the features described above, or as an alternative, further embodiments may include that the processing device comprises at least one of an elevator controller, a service tool and a cloud server.

In addition to one or more of the features described above, or as an alternative, further embodiments may include that the automated test procedure is initiated periodically according to a schedule programmed in a processing device comprising at least one of an elevator controller, a cloud server, and any other computing device.

In addition to one or more of the features described above, or as an alternative, further embodiments may include that the automated test procedure is initiated at least one of daily, weekly and monthly.

According to yet another aspect of the disclosure, an elevator brake testing system includes an electronic safety actuator coupled to an elevator car for actuating a safety brake. Also included is a controller in operative communication with the electronic safety actuator. Further included is a remote device. Yet further included is a network wirelessly connecting the controller to the remote device, the remote device remotely initiating an automated test of the elevator brake testing system by triggering the electronic safety actuator, the controller communicating braking data received to the remote device for comparison with at least one predetermined acceptable range.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
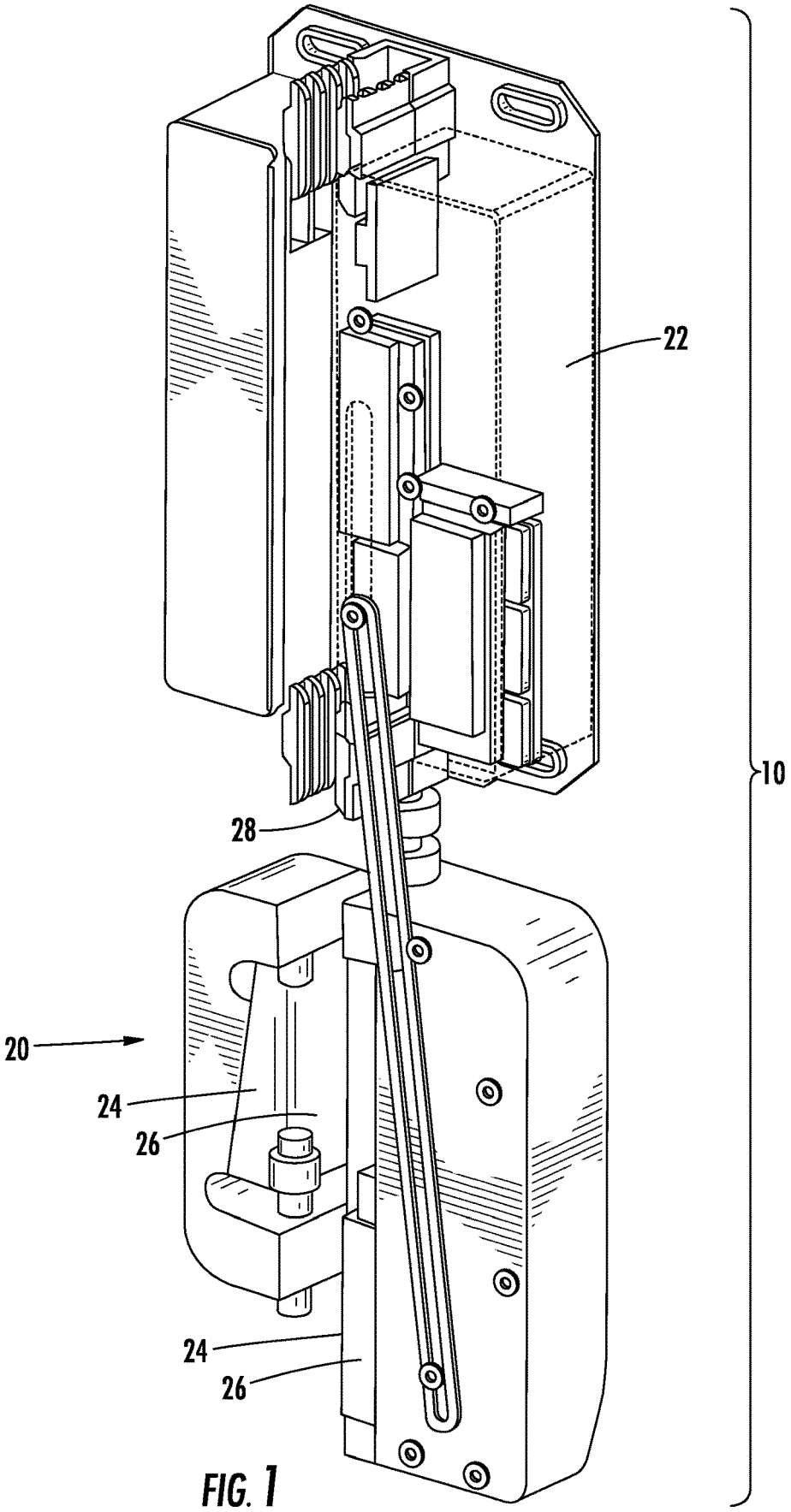
FIG. 1 is a perspective view of an elevator braking system.
Figure 2:
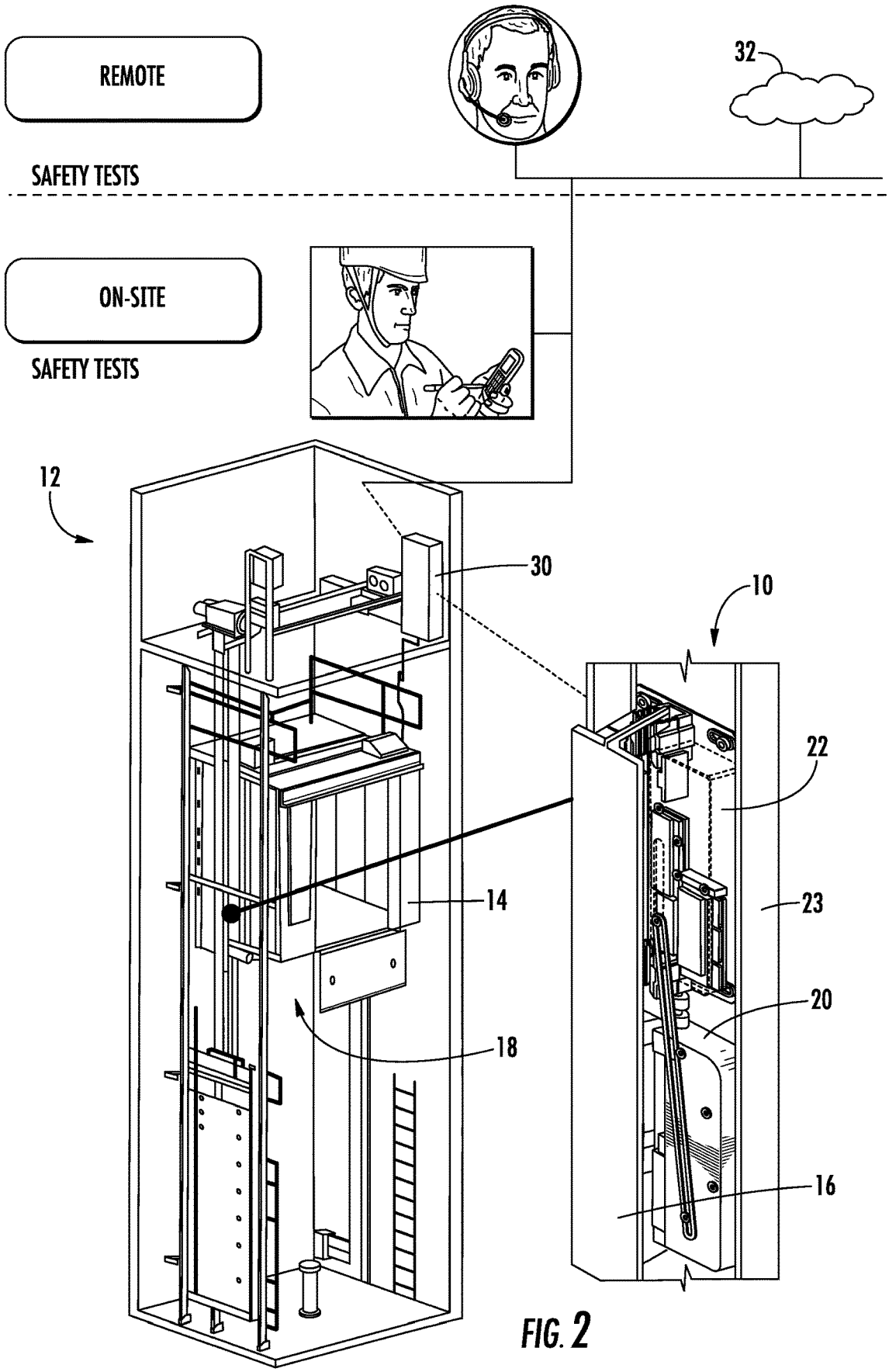
FIG. 2 is a schematic view of an automated elevator brake testing system.

FIGS. 1 and 2 illustrate a brake assembly 10 for an elevator system 12. The elevator system includes an elevator car 14 that moves through an elevator car passage 18 (e.g., hoistway). The elevator car is guided by one or more guide rails 16 connected to a sidewall of the elevator car passage 18. The embodiments described herein relate to an overall braking system that is operable to assist in braking (e.g., slowing or stopping movement) of the elevator car 14. In one embodiment, the braking is performed relative to the guide rail 16. The brake assembly 10 can be used with various types of elevator systems.

The brake assembly 10 includes a safety brake 20 and an electronic safety actuator 22 that are each operatively coupled to the elevator car 14. In some embodiments, the safety brake 20 and the electronic safety actuator 22 are mounted to a car frame 23 of the elevator car 14. The safety brake 20 includes a brake member 24, such as a brake pad or a similar structure suitable for repeatable braking engagement, with the guide rail 16. The brake member 24 has a contact surface 26 that is operable to frictionally engage the guide rail 16. In one embodiment, the safety brake 20 and an electronic safety actuator 22 may be combined into a single unit.

The safety brake 20 is operable between a non-braking position and a braking position. The non-braking position is a position that the safety brake 20 is disposed in during normal operation of the elevator car 14. In particular, the contact surface 26 of the brake member 24 is not in contact with, or is in minimal contact with, the guide rail 16 while in the non-braking position, and thus does not frictionally engage the guide rail 16. In the braking position, the frictional force between the contact surface 26 of the brake member 24 and the guide rail 16 is sufficient to stop movement of the elevator car 14 relative to the guide rail 16. Various triggering mechanisms or components may be employed to actuate the safety brake 20 and thereby move the contact surface 26 of the brake member 24 into frictional engagement with the guide rail 16. In the illustrated embodiment, a link member 28 is provided and couples the electronic safety actuator 22 and the safety brake 20. Movement of the link member 28 triggers movement of the brake member 24 of the safety brake 20 from the non-braking position to the braking position.

In operation, an electronic sensing device and/or a controller 30 is configured to monitor various parameters and conditions of the elevator car 14 and to compare the monitored parameters and conditions to at least one predetermined condition. In one embodiment, the predetermined condition comprises speed and/or acceleration of the elevator car 14. In the event that the monitored condition (e.g., over-speed, over-acceleration, etc.) meets the predetermined condition, the electronic safety actuator 22 is actuated to facilitate engagement of the safety brake 20 and the guide rail 16. In some embodiments, the electronic safety actuator 22 has a velocity sensor and an accelerometer. Data is analyzed by the controller and/or the electronic safety device 22 both to determine if there is an overspeed or overacceleration condition. If such a condition is detected, the electronic safety actuator 22 activates, thereby pulling up on the link member 28 and driving the contact surface 26 of the brake member 24 into frictional engagement with the guide rail 16 applying the brakes. In some embodiments, the electronic safety actuator 22 sends this data to the elevator controller 30 and the controller sends it back to the electronic safety actuator 22 and tells it to activate.

In an embodiment two electronic safety actuators 22 (one on each guide rail) are provided and connected to a controller on the elevator car 14 that gets data from the electronic safety actuators 22 and initiates activation of the electronic safety actuators 22 for synchronization purposes. In further embodiments, each electronic safety actuator 22 decides to activate on its own. Still further, one electronic safety actuator 22 may be "smart" and one is "dumb," where the smart electronic safety actuator gathers the speed/acceleration data and sends a command to the dumb one to activate along with the smart electronic safety actuator.

The embodiments described herein utilize the electronically monitored and controlled electronic safety actuator 22 to conduct automated safety brake testing. The automated safety brake testing ensures that the brake assembly 10 is operating in a desired manner. For example, the testing determines if the brake assembly 10 is stopping the elevator car 14 within a predetermined distance and at a predetermined deceleration, for example. The automated testing is facilitated with wired or wireless communication between the controller 30 and the electronic safety actuator 22. In one embodiment, the electronic safety actuator 22 may directly connect over a cellular, Bluetooth, or any other wireless connection to a processing device, such as the controller 30, a mechanic's service tool (such as a mobile phone, tablet, laptop, or dedicated service tool), a remote computer, or a cloud server, for example. As described herein, an elevator brake testing system and an automated method of testing the brake assembly 10 are provided. The testing may be carried out by manual command by an individual located in close or remote proximity to the brake assembly 10 and/or the controller 30. In one embodiment, the testing may be carried out automatically by the controller 30, a cloud server, or other remote computing device. An individual is considered in proximity to the brake assembly 10 when the individual is able to physically interact with the brake assembly 10 and/or the controller 30. Interaction with the brake assembly 10 and/or the controller 30 may be carried out by manually contacting the structural components, such as with a tool, or may be done with a mobile device that is in wireless communication with the controller 30 directly or through a local network. This is considered on-site testing. In other embodiments, a remote connection is established between the controller 30 and a remote device that is not located at the elevator system 12 location to perform the testing in what is referred to as remote testing. The remote device is connected to the controller 30 via a network 32 or some other remote wireless connection, such as cellular.

Figure 3:
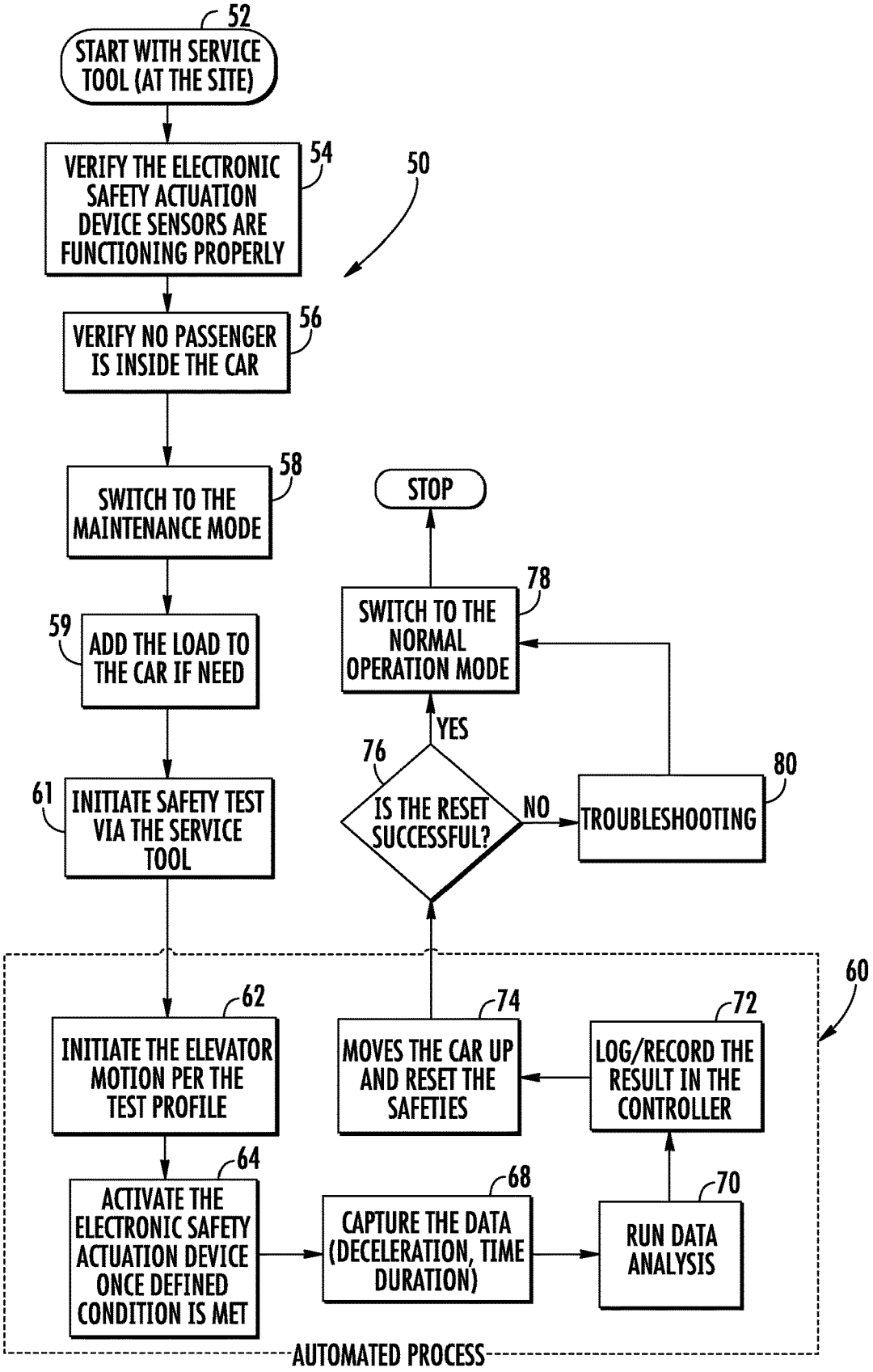
FIG. 3 is a flow diagram illustrating a method of testing of an elevator safety brake system according to an aspect of the disclosure.

Referring now to FIG. 3, a flow diagram illustrates a method of partially automated testing initiated on-site by an individual, such as a mechanic at 50. A test of the brake assembly 10 is initiated at 52 by an individual located proximate the elevator system, as described above in connection with on-site testing. In one embodiment, proximate may mean located anywhere in or near the building in which the elevator system is installed. Initiation may be done by interacting with a user interface, such as a keyboard or touch screen, for example, or with a tool. The on-site testing verifies that electronic safety actuation sensors are functioning properly at 54. This may include verification related to various safety actuation device sensors, such as accelerometer(s), speed sensing sensor(s), and/or absolute position system, for example. The on-site testing also verifies that no passenger(s) is in the elevator car at 56. Verification that the elevator car is empty may be done in various ways. For example, in some embodiments a camera viewing an interior of the elevator car 14 is monitored by the individual monitoring the test to determine that the elevator car 14 is empty. In other embodiments, a weight sensor may be utilized to verify a no-load condition. Other methods for verifying that there are no occupants (i.e., passengers) in the car may also be used. Once verification related to the electronic safety actuation device sensors and the no-load condition is made, the elevator system 12 is switched from a normal operating mode to a maintenance mode at 58. In some embodiments, it is desirable to conduct the test in a loaded condition, so a load, such as metal weights, may be added to the elevator car, if needed at 59. The maintenance mode at 58 does not allow the elevator car 14 to respond to elevator car requests and limits operation of the elevator car 14 within the system.

Figure 7:
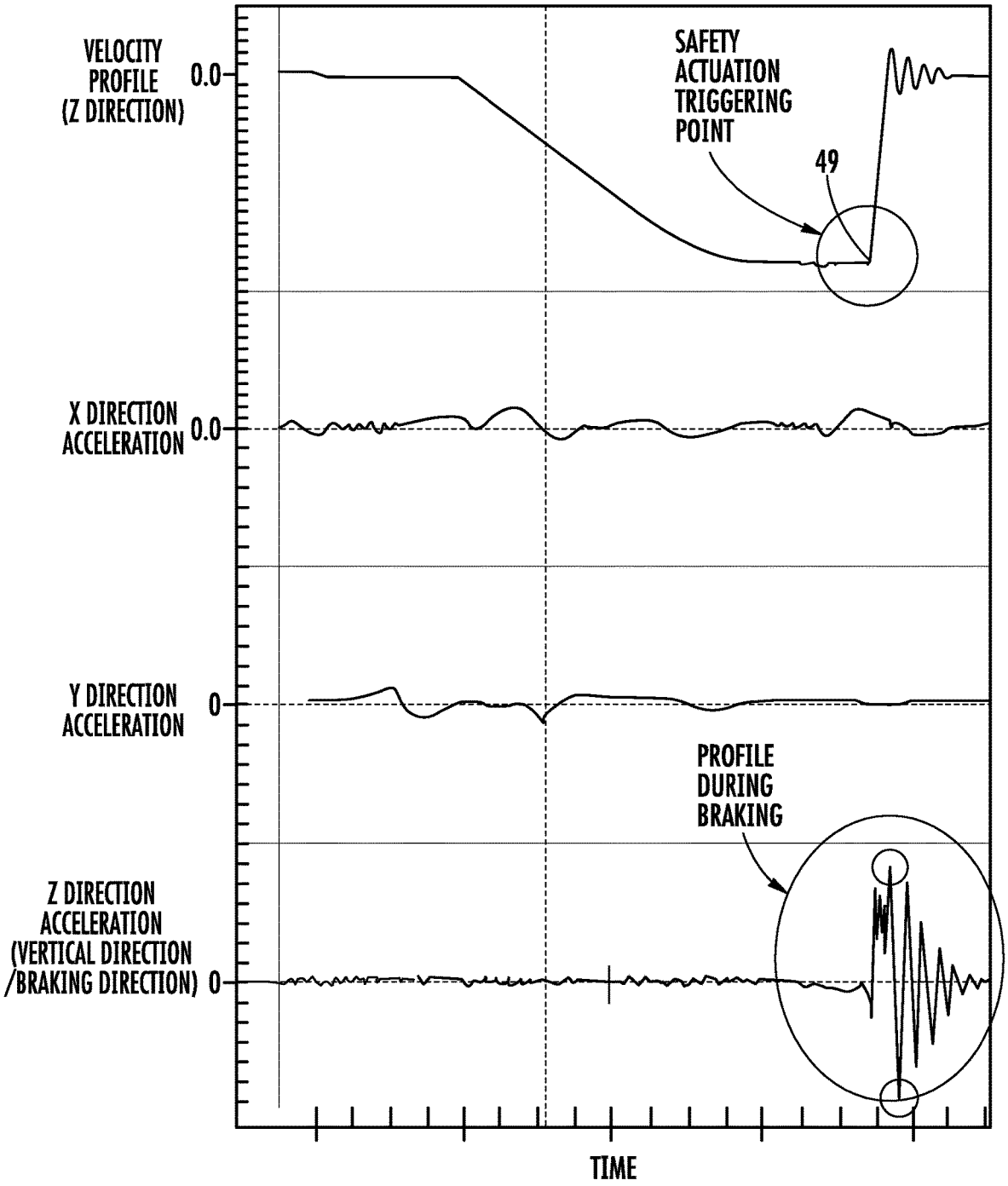
FIG. 7 is a test motion profile of the elevator safety brake system.

Once the elevator car 14 is in the maintenance mode, the fully automated portion at 60 of the test is performed upon test initiation at 61 by the individual operating the test. During the automated portion at 60 of the test, elevator car 14 motion is initiated at 62 according to a predefined motion test profile, such as that illustrated in FIG. 7, with a safety actuation triggering point represented with numeral 49 and velocity and acceleration profiles illustrated during braking. Once a defined motion condition is met during the motion test profile (e.g., overspeed condition), the electronic safety actuator 22 is activated at 64. Activation, or triggering, of the electronic safety actuator 22 actuates the safety brake 20 to decelerate the elevator car 14. During the braking process, braking data is captured and transferred to the controller, the cloud server, and/or a remote or local mechanic's tool at 68. The braking data includes, but is not limited to, the distance required to bring the elevator car 14 to a complete stop, the deceleration of the elevator car 14 during the braking process, the time required to bring the elevator car 14 to a complete stop, etc. For example, the following equation may represent an analysis of the braking data:

$$S=V\times(T2-T1)+0.5\times A\times(T2-T1)\times(T2-T1)$$

where: S=slipping distance; V=speed; A=deceleration; T1=time that safety is actuated; and T2=time that car is stopped.

The controller 30, cloud server, and/or remote or local mechanic's tool analyzes the braking data at 70. Analyzing the braking data includes determining if the braking data captured and analyzed is deemed adequate according to one or more parameters stored in the controller, cloud server, and/or remote or local mechanic's tool. There may be more than one category of adequate determinations, such as adequate or passed but requires service soon. In some embodiments, the analysis includes comparing the braking data to at least one predetermined acceptable range of at least one braking parameter (e.g., braking distance, braking time, deceleration, etc.). In particular, for each safety (i.e. left safety might have deceleration A-Left, and right safety has deceleration A-Right), data related to S-Left and S-Right, respectively, will be captured and calculated. To ensure it passes the test, the slipping distance and deceleration must meet requirements that are code specified. From the maintenance perspective, by comparing the difference of S-Left and S-Right, i.e. $\Delta S$=(S-Left−S-Right), if $\Delta S$ is not bigger than predefined number, then the safety components are deemed in good condition. The analysis is recorded at 72 in the controller 30, cloud server, and/or remote or local mechanic's tool. The elevator car 14 is moved up and the electronic safety actuator 22 is reset at 74, thereby allowing the elevator car to resume normal movement throughout the elevator car passage 18.

Once the fully automated portion of the test is complete, the individual operating the test determines if the reset is successful at 76. The individual also evaluates an automated report that is generated to determine if the braking data is within the acceptable predefined range(s). In one embodiment, the individual may receive the raw data from the test. If the reset was successful and the data is acceptable, the elevator car 14 is switched back to a normal operating mode at 78. If not, the individual conducts or initiates troubleshooting efforts at 80.

Figure 4:
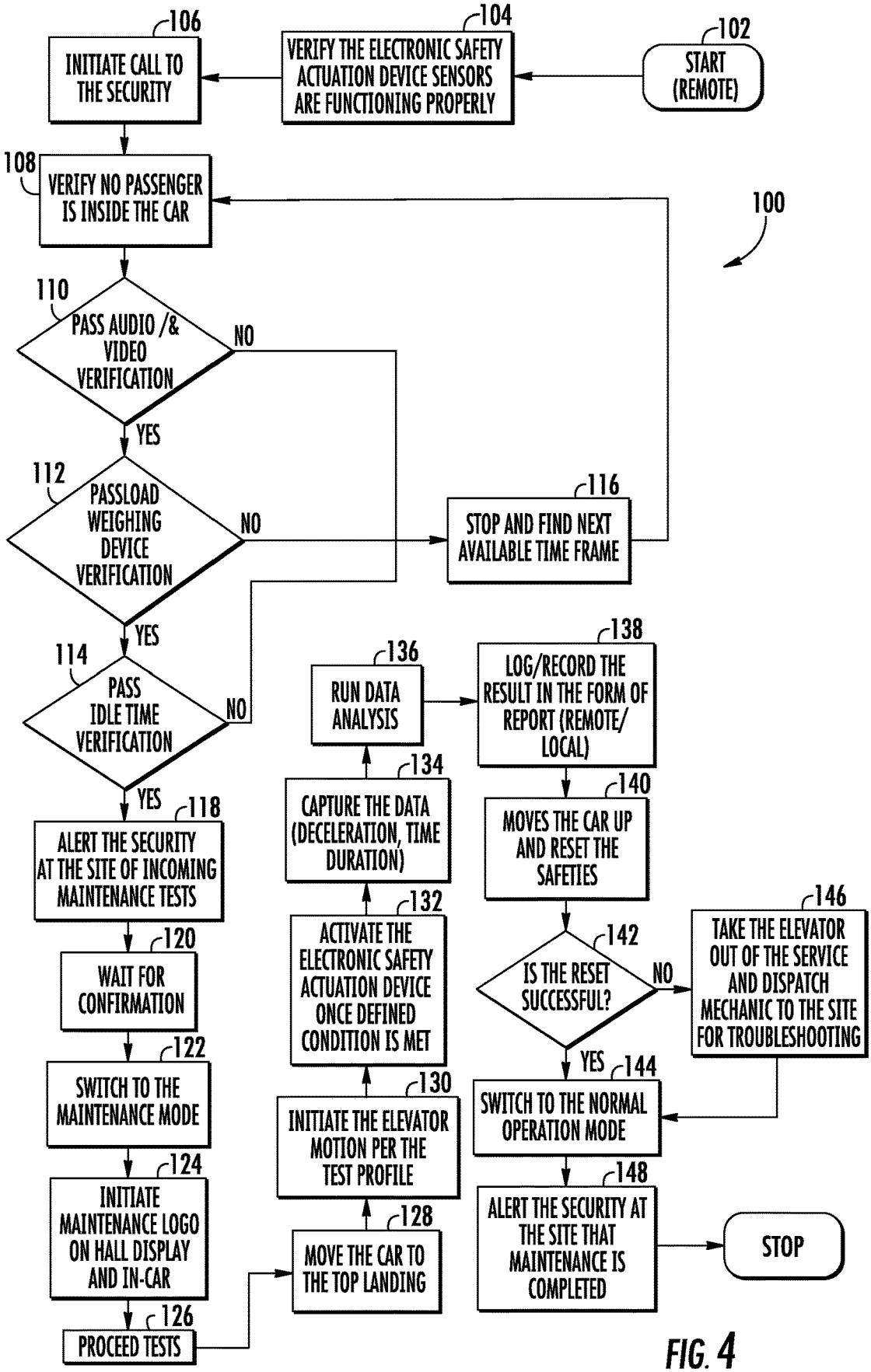
FIG. 4 is a flow diagram illustrating a method of testing of an elevator safety brake system according to another aspect of the disclosure.

Referring now to FIG. 4, a flow diagram illustrates a method of partially automated testing initiated by an individual located remote relative to the elevator system at 100. An automated test of the brake assembly 10 is initiated at 102 and monitored by the individual located remote relative to the elevator system, as described above in connection with remote testing. The individual interacts with a remote device, such as a keyboard, touch screen, etc. to provide test commands and to view output reports. As described above, the remote device is wirelessly connected to the controller 30 via a wireless communication network.

The individual establishes a connection to the controller 30 and verifies that electronic safety actuation sensors are functioning properly at 104. The individual then communicates with personnel, such as security, located on-site at the elevator system at 106 to notify on-site personnel that the elevator car 14 will be the subject of testing for a period of time. The individual verifies that no passenger(s) is in the elevator car at 108. Verification that the elevator car is empty may be done in various ways. In the illustrated embodiment, a camera viewing an interior of the elevator car 14 is monitored by the individual monitoring the automated test to visually and/or audibly determine at 110 that the elevator car 14 is empty. Additionally, a weight sensor may be utilized to verify a no-load condition at 112. Other methods for verifying that there are no passengers in the car may also be used. Furthermore, a predefined idle time maybe required for further verification at 114. It is to be understood that more or less of the illustrated no-load verification steps may be employed in some embodiments. If a no-load condition is not verified, the test is stopped and a test is attempted at a later time at 116. Once verification related to the electronic safety actuation sensors and the no-load condition is made, individual alerts the on-site personnel that the test will commence at 118. Upon receipt of confirmation from the on-site personnel at 120, the elevator system 12 is switched from a normal operating mode to a maintenance mode at 122. The maintenance mode at 122 does not allow the elevator car 14 to respond to elevator car requests and limits operation of the elevator car 14 within the system. A visual or audible alert in the elevator car and/or the hallway may be provided to indicate the maintenance mode at 124.

Once the elevator car 14 is in the maintenance mode, the fully automated portion of the test is performed upon test initiation at 126 by the individual operating the test. In some embodiments, the elevator car 14 is moved to the top landing of the elevator passage at 128. During the automated portion of the test, elevator car 14 motion is initiated at 130 according to a predefined motion test profile, such as that illustrated in FIG. 7, with a safety actuation triggering point represented with numeral 49 and velocity and acceleration profiles illustrated during braking. Once a defined motion condition is met during the motion test profile (e.g., overspeed condition), the electronic safety actuator 22 is activated at 132. Activation, or triggering, of the electronic safety actuator 22 actuates the safety brake 20 to decelerate the elevator car 14. During the braking process, braking data is captured and transferred to the controller, the cloud server, and/or a remote or local mechanic's tool at 134. The braking data includes, but is not limited to, the distance required to bring the elevator car 14 to a complete stop, the deceleration of the elevator car 14 during the braking process, the time required to bring the elevator car 14 to a complete stop, etc. For example, the following equation may represent an analysis of the braking data:

$$S=V\times(T2-T1)+0.5\times A\times(T2-T1)\times(T2-T1)$$

where: S=slipping distance; V=speed; A=deceleration; T1=time that safety is actuated; and T2=time that car is stopped.

The controller 30 and/or cloud server analyzes the braking data at 136. Analyzing the braking data includes determining if the braking data captured and analyzed is deemed adequate according to one or more parameters stored in the controller, cloud server, and/or remote or local mechanic's tool. There may be more than one category of adequate determinations, such as adequate or passed but requires service soon. In some embodiments, the analysis includes comparing the braking data to at least one predetermined acceptable range of at least one braking parameter (e.g., braking distance, braking time, deceleration, etc.). In particular, for each safety (i.e. left safety might have deceleration A-Left, and right safety has deceleration A-Right), data related to S-Left and S-Right, respectively, will be captured and calculated. To ensure it passes the test, the slipping distance and deceleration must meet requirements that are code specified. From the maintenance perspective, by comparing the difference of S-Left and S-Right, i.e. $\Delta S$=(S-Left−S-Right), if $\Delta S$ is not bigger than predefined number, then the safety components are deemed in good condition. The analysis is recorded at 138 in the controller 30 and/or cloud server. The elevator car 14 is moved up and the electronic safety actuator 22 is reset at 140, thereby allowing the elevator car to resume normal movement throughout the elevator car passage 18. The individual conducting the test is provided with a report of the data analysis.

Once the fully automated portion of the test is complete, the individual operating the test determines if the reset is successful at 142 and evaluates the automated report that is generated to determine if the braking data is within the acceptable predefined range(s). If the reset was successful and the data is acceptable, the elevator car 14 is switched back to a normal operating mode at 144. If not, the individual conducts or initiates troubleshooting efforts at 146. This may include taking the elevator out of service and dispatching a mechanic to the site for troubleshooting. Once the normal mode of operation is initiated, the individual conducting the test alerts the on-site personnel that maintenance is complete at 148.

Figure 5:
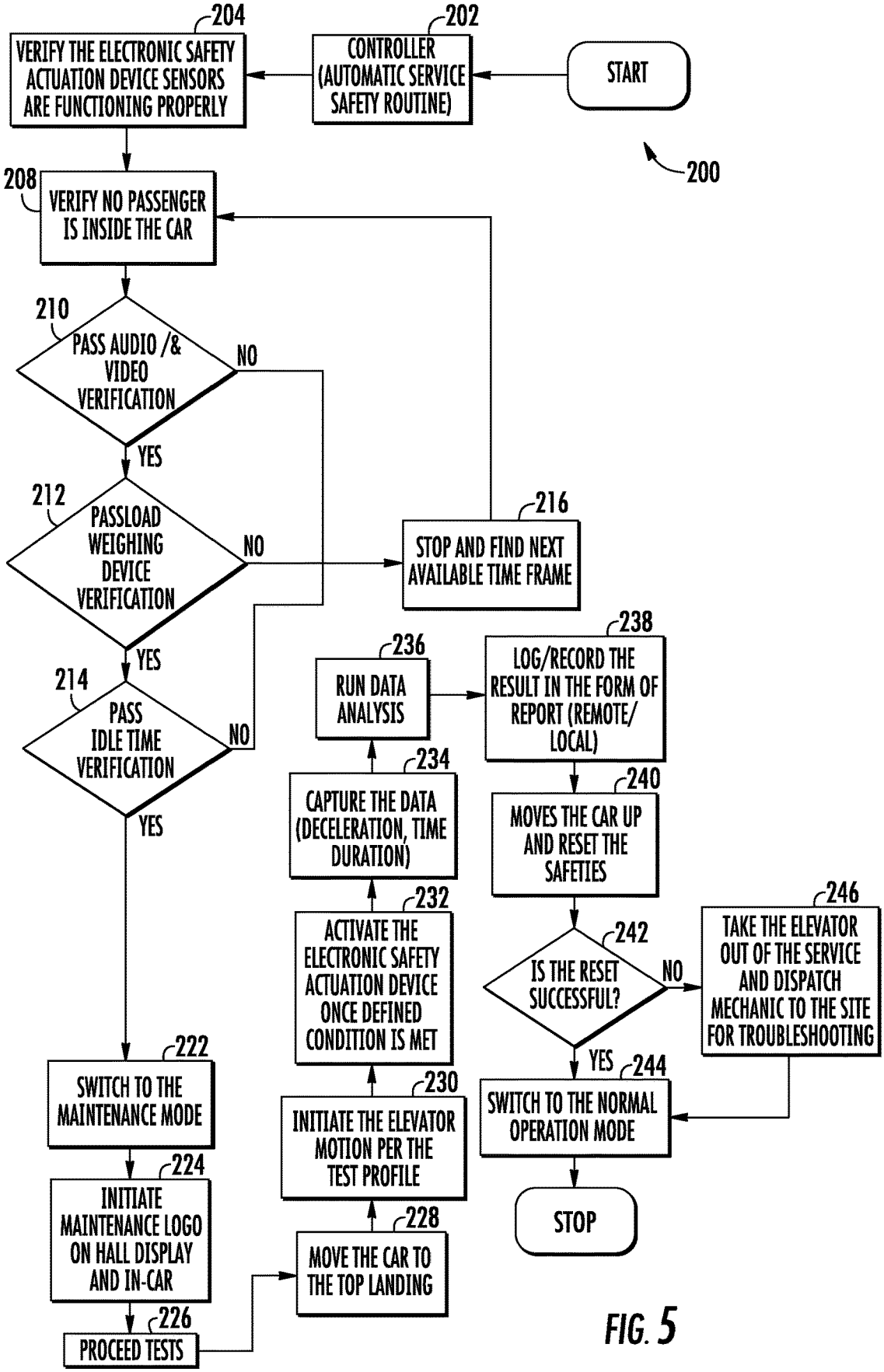
FIG. 5 is a flow diagram illustrating a method of automated testing of an of an elevator safety brake system according to another aspect of the disclosure.

Referring now to FIG. 5, a flow diagram illustrates a method of fully automated testing initiated by a local device, such as controller 30 at 200. An automated test of the brake assembly 10 is initiated at 202 by the controller as part of an automatic service safety routine. Initiation may be based on any given schedule that is programmed in the brake assembly 10, such as in a processing device (e.g., a controller). For example, an automated test may be initiated daily, weekly, monthly or any other specified interval. The controller 30 verifies that electronic safety actuation sensors are functioning properly at 204 and verifies that no passenger(s) is in the elevator car at 208. Verification that the elevator car is empty may be done in various ways. In the illustrated embodiment, audio and/or video verification may be utilized to determine at 210 that the elevator car 14 is empty. Additionally, a weight sensor may be utilized to verify a no-load condition at 212. Other methods for verifying that there are no passengers in the car may also be used. Furthermore, a predefined idle time maybe required for further verification at 214. It is to be understood that more or less of the illustrated no-load verification steps may be employed in some embodiments. If a no-load condition is not verified, the test is stopped and a test is attempted at a later time at 216. Once verification related to the electronic safety actuation sensors and the no-load condition is made, the elevator system 12 is switched from a normal operating mode to a maintenance mode at 222. The maintenance mode at 222 does not allow the elevator car 14 to respond to elevator car requests and limits operation of the elevator car 14 within the system. A visual or audible alert in the elevator car and/or the hallway may be provided to indicate the maintenance mode at 224.

Once the elevator car 14 is in the maintenance mode, fully automated testing is performed upon test initiation at 226. In some embodiments, the elevator car 14 is moved to the top landing of the elevator passage at 228. During the automated portion of the test, elevator car 14 motion is initiated at 230 according to a predefined motion test profile, such as that illustrated in FIG. 7, with a safety actuation triggering point represented with numeral 49 and velocity and acceleration profiles illustrated during braking. Once a defined motion condition is met during the motion test profile (e.g., overspeed condition), the electronic safety actuator 22 is activated at 232. Activation, or triggering, of the electronic safety actuator 22 actuates the safety brake 20 to decelerate the elevator car 14. During the braking process, braking data is captured and transferred to the controller at 234. The braking data includes, but is not limited to, the distance required to bring the elevator car 14 to a complete stop, the deceleration of the elevator car 14 during the braking process, the time required to bring the elevator car 14 to a complete stop, etc. For example, the following equation may represent an analysis of the braking data:

$$S=V\times(T2-T1)+0.5\times A\times(T2-T1)\times(T2-T1)$$

where: S=slipping distance; V=speed; A=deceleration; T1=time that safety is actuated; and T2=time that car is stopped.

The controller 30 analyzes the braking data at 236. Analyzing the braking data includes determining if the braking data captured and analyzed is deemed adequate according to one or more parameters stored in the controller, cloud server, and/or remote or local mechanic's tool. There may be more than one category of adequate determinations, such as adequate or passed but requires service soon. In some embodiments, the analysis includes comparing the braking data to at least one predetermined acceptable range of at least one braking parameter (e.g., braking distance, braking time, deceleration, etc.). In particular, for each safety (i.e. left safety might have deceleration A-Left, and right safety has deceleration A-Right), data related to S-Left and S-Right, respectively, will be captured and calculated. To ensure it passes the test, the slipping distance and deceleration must meet requirements that are code specified. From the maintenance perspective, by comparing the difference of S-Left and S-Right, i.e. ΔS=(S-Left−S-Right), if ΔS is not bigger than predefined number, then the safety components are deemed in good condition. The analysis is recorded at 238 in the controller 30. The elevator car 14 is moved up and the electronic safety actuator 22 is reset at 240, thereby allowing the elevator car to resume normal movement throughout the elevator car passage 18.

A determination is then made regarding whether the reset is successful at 242 and evaluates the automated report that is generated to determine if the braking data is within the acceptable predefined range(s). If the reset was successful and the data is acceptable, the elevator car 14 is switched back to a normal operating mode at 244. If not, the controller 30 conducts or initiates troubleshooting efforts at 246. This may include taking the elevator out of service and dispatching a mechanic to the site for troubleshooting.

Figure 6:
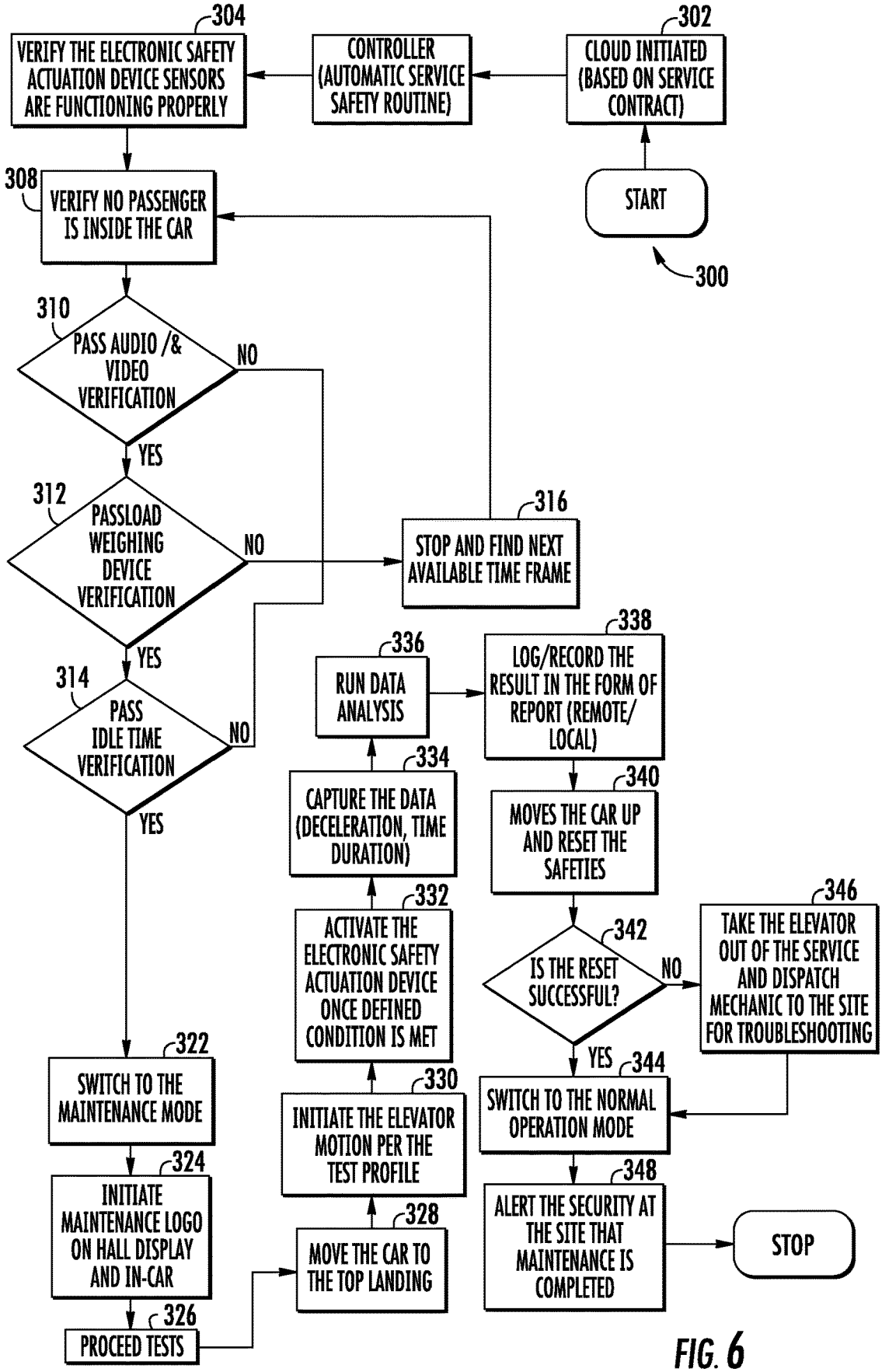
FIG. 6 is a flow diagram illustrating a method of automated testing of an elevator safety brake system according to another aspect of the disclosure.

Referring now to FIG. 6, a flow diagram illustrates a method of fully automated testing initiated by a remote device, such as cloud server at 300. An automated test of the brake assembly 10 is initiated at 302 by the cloud server as part of an automatic service safety routine. Initiation may be based on any given schedule that is programmed in the brake assembly 10, such as in a processing device (e.g., a controller). For example, an automated test may be initiated daily, weekly, monthly or any other specified interval. The cloud server verifies that electronic safety actuation sensors are functioning properly at 304 and verifies that no passenger(s) is in the elevator car at 308. Verification that the elevator car is empty may be done in various ways. In the illustrated embodiment, audio and/or video verification may be utilized to determine at 310 that the elevator car 14 is empty. Additionally, a weight sensor may be utilized to verify a no-load condition at 312. Other methods for verifying that there are no passengers in the car may also be used. Furthermore, a predefined idle time maybe required for further verification at 314. It is to be understood that more or less of the illustrated no-load verification steps may be employed in some embodiments. If a no-load condition is not verified, the test is stopped and a test is attempted at a later time at 316. Once verification related to the electronic safety actuation sensors and the no-load condition is made, the elevator system 12 is switched from a normal operating mode to a maintenance mode at 322. The maintenance mode at 322 does not allow the elevator car 14 to respond to elevator car requests and limits operation of the elevator car 14 within the system. A visual or audible alert in the elevator car and/or the hallway may be provided to indicate the maintenance mode at 324.

Once the elevator car 14 is in the maintenance mode, fully automated testing is performed upon test initiation at 326. In some embodiments, the elevator car 14 is moved to the top landing of the elevator passage at 328. During the automated portion of the test, elevator car 14 motion is initiated at 330 according to a predefined motion test profile, such as that illustrated in FIG. 7, with a safety actuation triggering point represented with numeral 49 and velocity and acceleration profiles illustrated during braking. Once a defined motion condition is met during the motion test profile (e.g., overspeed condition), the electronic safety actuator 22 is activated at 332. Activation, or triggering, of the electronic safety actuator 22 actuates the safety brake 20 to decelerate the elevator car 14. During the braking process, braking data is captured and transferred to the controller at 334. The braking data includes, but is not limited to, the distance required to bring the elevator car 14 to a complete stop, the deceleration of the elevator car 14 during the braking process, the time required to bring the elevator car 14 to a complete stop, etc. For example, the following equation may represent an analysis of the braking data:

$$S=V\times(T2-T1)+0.5\times A\times(T2-T1)\times(T2-T1)$$

where: S=slipping distance; V=speed; A=deceleration; T1=time that safety is actuated; and T2=time that car is stopped.

The cloud server analyzes the braking data at 336. Analyzing the braking data includes determining if the braking data captured and analyzed is deemed adequate according to one or more parameters stored in the controller, cloud server, and/or remote or local mechanic's tool. There may be more than one category of adequate determinations, such as adequate or passed but requires service soon. In some embodiments, the analysis includes comparing the braking data to at least one predetermined acceptable range of at least one braking parameter (e.g., braking distance, braking time, deceleration, etc.). In particular, for each safety (i.e. left safety might have deceleration A-Left, and right safety has deceleration A-Right), data related to S-Left and S-Right, respectively, will be captured and calculated. To ensure it passes the test, the slipping distance and deceleration must meet requirements that are code specified. From the maintenance perspective, by comparing the difference of S-Left and S-Right, i.e. ΔS=(S-Left−S-Right), if ΔS is not bigger than predefined number, then the safety components are deemed in good condition. The analysis is recorded at 338 in the controller 30. The elevator car 14 is moved up and the electronic safety actuator 22 is reset at 340, thereby allowing the elevator car to resume normal movement throughout the elevator car passage 18.

A determination is then made regarding whether the reset is successful at 342 and evaluates the automated report that is generated to determine if the braking data is within the acceptable predefined range(s). If the reset was successful and the data is acceptable, the elevator car 14 is switched back to a normal operating mode at 344. If not, the cloud server conducts or initiates troubleshooting efforts at 346. This may include taking the elevator out of service and dispatching a mechanic to the site for troubleshooting.

The embodiments described herein, the safety brake testing is performed in a partially or fully automated manner. This reduces the personnel required to perform the testing on-site and the time required to conduct the test. In the case of remote testing, the need for a mechanic to travel to and from the site is avoided and even may be completely eliminated in the case of automated testing. Additionally, remote and/or automated testing allows for more frequent testing, thereby promoting system operator confidence beyond code requirements. Furthermore, the automated test provides a standardized testing methodology by reducing subjective human analysis.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., a processor, apparatus or system) to perform one or more methodological acts as described herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

What is claimed is:

1. A method of testing of an elevator safety brake system comprising:

initiating an automated test procedure by initiating elevator car motion according to a predefined motion test profile;

upon meeting an overspeed condition of the predefined motion test profile, triggering an electronic safety actuator mounted to an elevator car and operatively coupled to a brake member that frictionally engages a guide rail during braking operation, wherein the elevator safety brake system includes the electronic safety actuator and a safety brake;

generating braking data about performance of the electronic safety actuator;

analyzing the braking data; and generating a report to indicate whether the elevator safety brake system performed adequately.

2. The method of claim 1, further comprising transferring the generated data to an elevator system processing device, wherein the elevator system processing device is at least one of an elevator system controller, a cloud server, and a service tool.

3. The method of claim 2, wherein the automated test procedure is initiated by an individual located proximate the elevator system processing device, the processing device comprising at least one of an elevator system controller, a cloud server, and any other computing device.

4. The method of claim 3, wherein the individual interacts with the elevator system controller manually with a user interface.

5. The method of claim 3, wherein the individual interacts with the controller with a mobile device in wireless communication with the controller.

6. The method of claim 1, wherein the braking data comprises at least one of a braking distance and a deceleration of an elevator car that the electronic safety actuator is coupled to.

7. The method of claim 1, further comprising ensuring that there are no occupants in an elevator car to be tested prior to triggering the electronic safety actuator.

8. The method of claim 7, wherein ensuring that there are no occupants is performed by at least one of visually ensuring with a camera viewing an interior of the elevator car and analyzing data from weight sensors.

9. The method of claim 7, wherein ensuring that there are no occupants is performed automatically by an elevator system processing device with no human interaction.

10. The method of claim 9, wherein the automated test procedure is initiated periodically according to a schedule programmed in the elevator system processing device, the processing device comprising at least one of an elevator system controller, a cloud server, and any other computing device.

11. The method of claim 10, wherein the automated test procedure is initiated at least one of daily, weekly and monthly.

12. The method of claim 1, further comprising establishing a remote connection between a remote device and an elevator system controller, the remote device not located at the location that the elevator system controller is located, wherein the automated test procedure is initiated by a remote operator that is remotely located relative to the elevator safety brake system and initiates the automated test procedure with a remote device.

13. The method of claim 12, wherein the remote operator interacts with the remote device and security personnel at the location of the elevator system controller.

14. The method of claim 12, further comprising ensuring that there are no occupants in the elevator car by:

passing an audio and video verification;

passing a load weighing verification; and passing an idle time verification.

15. The method of claim 1, wherein the elevator safety brake system includes the electronic safety actuator, the safety brake and a link member coupling the electronic safety actuator to the safety brake.

16. A method of automated testing of an elevator safety brake system comprising:

initiating an automated test procedure with a processing device in operative communication with an electronic safety actuator by initiating elevator car motion according to a predefined motion test profile;

upon meeting an overspeed condition of the predefined motion test profile, triggering an electronic safety actuator, wherein the elevator safety brake system includes the electronic safety actuator and a safety brake;

generating braking data about performance of the electronic safety actuator, the electronic safety actuator mounted to an elevator car and operatively coupled to a brake member that frictionally engages a guide rail during braking operation;

analyzing the braking data; and generating a report to indicate whether the elevator safety brake system performed adequately.

17. The method of claim 16, wherein the automated test is initiated by the processing device based on a periodic test schedule.

18. The method of claim 16, wherein the processing device comprises at least one of an elevator controller, a service tool and a cloud server.

19. The method of claim 16, wherein the automated test procedure is initiated periodically according to a schedule programmed in a processing device comprising at least one of an elevator controller, a cloud server, and any other computing device.

* * * * *